United States Patent [19]

Wilson et al.

[11] 3,989,477

[45] Nov. 2, 1976

[54] GAS ENRICHING APPARATUS

[76] Inventors: Stanley C. Wilson, 465 Jefferson Ave., Washington, Pa. 15301; Ralph J. Hils, 281 Thompsonville Road, McMurray, Pa. 15317

[22] Filed: Apr. 10, 1975

[21] Appl. No.: 566,803

Related U.S. Application Data

[63] Continuation of Ser. No. 411,343, Oct. 31, 1973, abandoned.

[52] U.S. Cl. ..... 48/144; 48/219; 261/122

[51] Int. Cl.[2] ..... C10J 1/08

[58] Field of Search ..... 48/144, 160, 190, 196 R, 48/203, 210, 219, 61; 261/77, 122; 44/80; 431/344

[56] References Cited

UNITED STATES PATENTS

| | | | |
|---|---|---|---|
| 1,295,349 | 2/1919 | Monroe | 431/344 |
| 2,665,200 | 1/1954 | Kwauk | 48/210 |
| 2,878,110 | 3/1959 | Altstaedt et al. | 48/203 |
| 3,039,862 | 6/1962 | Yocham | 48/144 |
| 3,057,708 | 10/1962 | Hilgers | 48/196 R |
| 3,733,185 | 5/1973 | Henes | 48/219 |

FOREIGN PATENTS OR APPLICATIONS

| | | | |
|---|---|---|---|
| 10,439 | 1899 | United Kingdom | 48/219 |
| 8,635 | 1900 | United Kingdom | 48/219 |

*Primary Examiner*—S. Leon Bashore
*Assistant Examiner*—Peter F. Kratz
*Attorney, Agent, or Firm*—William J. Ruano

[57] ABSTRACT

Enriching apparatus for low quality gas, such as methane as found trapped in mines, low B.T.U. gas, and/or air or combinations of either. Such gas and/or air is passed through naphthalene pellets and gasoline or other petrochemical products which then absorb properties of enriching materials and emit enriched gas in place of the low B.T.U. gas and/or air. Several enrichers may be connected in series and the enriched gas is then pressurized for use in a high pressure gas distribution line. Carbonaceous powder may be blown into the gas stream to further enrich it, for use in industrial applications.

7 Claims, 5 Drawing Figures

GAS ENRICHING APPARATUS

This is a continuation of application Ser. No. 411,343, filed Oct. 31, 1973, and now abandoned.

This invention relates to a method and apparatus for enriching low B.T.U. gas or air to make either or both combustible and in usable form.

In the past, various methods have been devised for making gas out of coal. However, such methods are quite complicated, requiring numerous apparatus units which involve considerable cost so as to make the method quite expensive.

An object of our invention is to overcome the shortcomings of the abovementioned methods of the prior art by resorting to an inexpensive apparatus and method for producing gas.

A more specific object of our invention is to enrich air, gas or both by dissolving pellets of naphthalene or similar material in gasoline or other petrochemical products while passing air under pressure therethrough so as to enrich the air to the point of forming combustible gas simulating natural gas.

Another object of our invention is to enrich gas or air by powdered waste carbonaceous material.

Other objects and advantages will become more apparent from a study of the following description taken with the accompanying drawings wherein.

Figure 1:
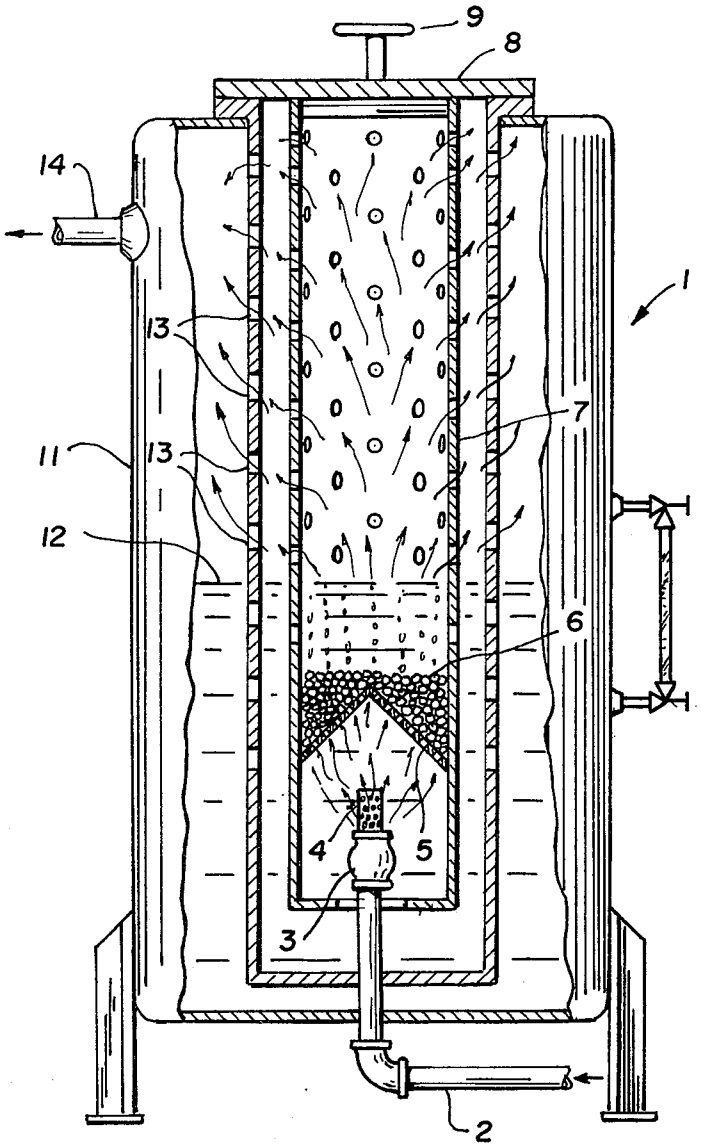
FIG. 1 is a vertical, cross-sectional view of a device for enriching low quality gas or air to make either or both combustible, in accordance with the principles of our invention.

Referring more particularly to FIG. 1 of the drawing, numeral 1 generally denotes a device for enriching low quality gas or simply air or a combination thereof sufficiently to make either or both combustible. Such apparatus is fed by a source of compressed air or low B.T.U. gas (or both) which flows into an inlet pipe 2, thence through a check valve 3 and perforated outlet pipe 4 from which the air and/or gas will flow, under pressure, through a screen 5 of inverted conical shape. Screen 5 supports a layer of pellets 6 of naphthalene or other gas generating material when dissolved in liquid gasoline or the like in the bottom portion of container 7.

A removable lid 8 having a handle 9 is provided to cover the top of container 7 and tank 11. Generated gas from the dissolved pellets 6, as shown by arrows, wil flow upwardly in container 7 and above the level of screen 5 through perforations in the vertical sidewalls of container 7, thence above liquid level 12, through perforations 13 in a surrounding container, to the interior of the tank 11 and finally through outlet pipe 14.

Figure 2:
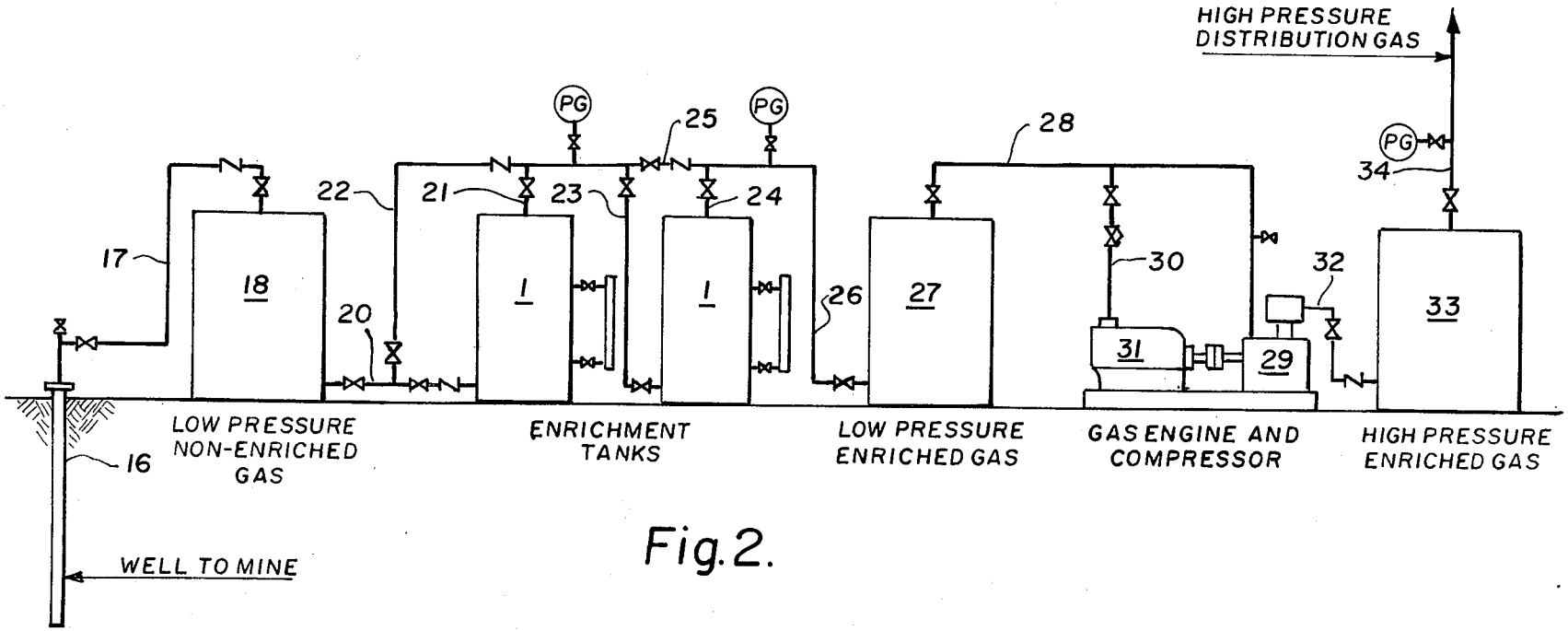
FIG. 2 is a schematic diagram of a system for withdrawing trapped methane from an abandoned mine to convert it to enriched gas available for use in a high pressure distribution line.

FIG. 2 shows a system embodying the enrichment tank of FIG. 1. Trapped methane gas in a coal mine is enriched by the structure shown in FIG. 1 and the pressure is increased so as to be useful in a high pressure gas distribution system. More specifically, pipe 16 extends into the ground to an abandoned coal mine whereby trapped methane gas at low pressure, that is, about 3 lbs. per square inch, will flow upwardly through shut-off and check valves in line 17, denoted by the symbol *x* and *z*, respectively, to a low pressure non-enriched gas supply tank 18. Thence, the non-enriched gas will flow through outlet pipe 20 to the lower portion of enrichment tank 1, which is of the same construction as shown in FIG. 1, then outwardly through outlet pipe 21 and pipe 23 to the lower portion of a second tank 1 and outwardly through pipes 24 and 26 to a tank 27 constituting a low pressure, enriched gas source. Instead, by suitably turning the various shut-off valves, either of the tanks 1 may be used, instead of both. Low pressure enriched gas flows from tank 27 through pipe 28 to a gas engine 31 which, in turn, drives a compressor 29, so that compressed enriched gas will flow through pipe 32 to tank 33, which is a source of high pressure enriched gas to flow out through pipe 34 to a high pressure distribution line.

Figure 3:
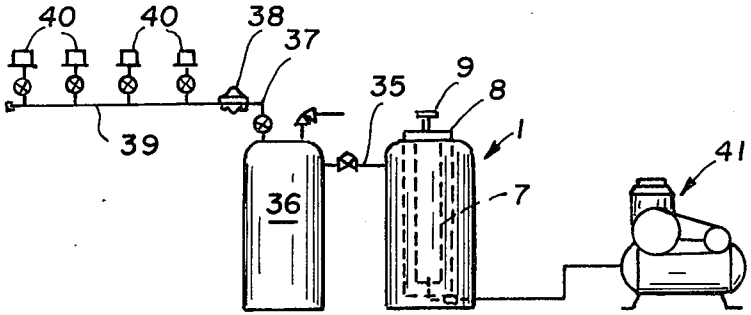
FIG. 3 is a modification of the device shown in FIG. 1 embodying its application to a camper stove or similar unit not served by a gas pipeline.

FIG. 3 shows a modification for use in a mountain cabin, or the like, where there is no gas but where there is electricity. An electric motor and compressor 41 provides a source of air under pressure to an enricher 1 of the construction shown in FIG. 1. Enriched gas flows through pipe 35 to a storage tank 36 which, in turn, supplies, through pipe 37 and pressure regulating valve 38, gas under pressure in line 39 which feeds gas burners 40. Of course, the supply tank 36 of enriched gas can be used for other purposes, such as fuel for a furnace of a home or for the carburetor of a car, bottled gas, etc.

Figure 4:
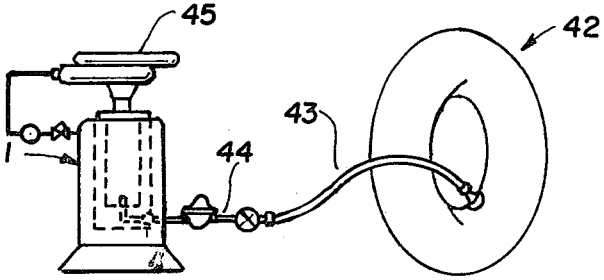
FIG. 4 is a further modification of the device shown in FIG. 1 showing an application thereof for use as a heating element for a camper stove when no electrical or gas source of energy is available.

FIG. 4 shows a still further modification for use at some isolated place, such as a camp area where air pressure is obtained from an inflated spare tire 42. Gas under pressure of about 30 to 60 lbs. flows through tube 43 and pressure regulator 44 to an enricher 1 of the construction shown in FIG. 1, thence to a gas burner 45.

Likewise, other applications will readily suggest themselves for the use of the present invention.

Figure 5:
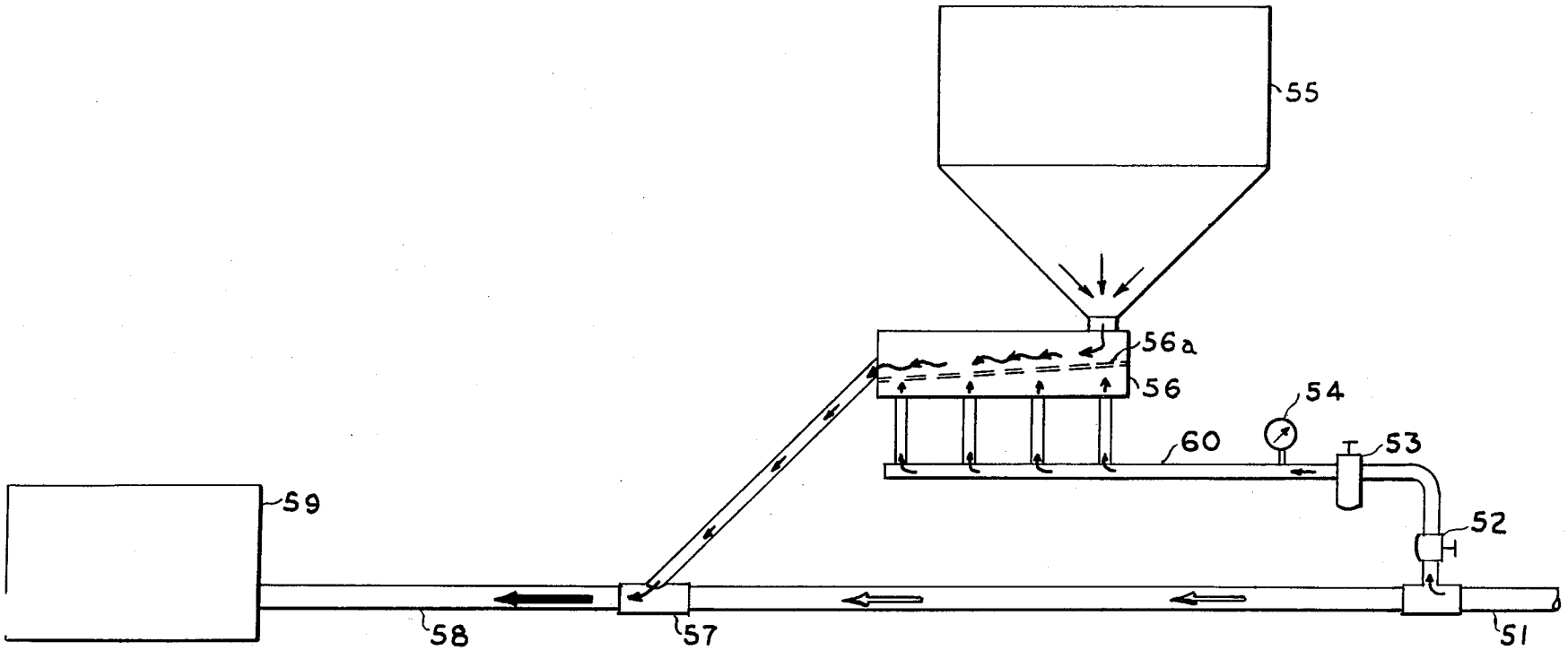
FIG. 5 shows a still further modification in which enrichment of gas or air is effected by burning powdered carbonaceous waste material.

FIG. 5 shows another modification of the invention wherein in addition to enriching the gas by the apparatus shown in FIG. 1, it may be further enriched by blowing carbonaceous powder into the gas stream so that the resulting flame is fueled both by gas and carbon particles. The carbon particles will ignite and completely burn to provide a high B.T.U. flame.

More specifically, either low quality non-enriched gas or gas enriched by the apparatus of FIG. 1 is introduced through a high pressure gas supply line 51 and portion of the gas is diverted through gate valve 52 and pressure regulator 53 through a low pressure gas line 60 whose pressure may be determined by a pressure gauge 54. Low pressure gas goes through parallel upwardly extending pipes into a fluidized bed transfer unit 56 including a screen 56*a* which is downwardly inclined, and which screen is fed by a hopper 55 which stores powdered carbonaceous material. As the carbonaceous, powdered material moves above and along the screen 56*a*, by upward lift or blowing of gas in vertical pipes, it will descend into a mixing chamber 57, thence to a mixed product supply line 58 to a combustion chamber 59 wherein both gas and powdered carbon are burned simultaneously in a flame providing complete combustion of the carbonaceous particles.

A suitable source or carbonaceous powder is that which is normally waste material, being a product of water scrubbers in a chimney of a power plant or the like. The carbonaceous material which would normally flow up the chimney is washed with water in a scrubber to protect the environment and such washed material, which is normally a waste material, can be used for the purposes of the present invention.

The slurry from the pollution control scrubbers has a composition of about 67% carbon; 2 to 12% fly ash; 2% sulphur; 2 to 3% phosphate; and the remainder of water. Such slurry is mixed with a binder, such as sodium silicate of 2 to 4% by weight, or other binder, such as linseed oil. A catalyst is mixed with the binder and slurry product and introduced into a mold. Hydraulic pressure is applied for forming different shapes, such as briquettes, pellets, large logs for burning in a fireplace, etc.

Thus it will be seen that we have provided a highly efficient system for converting a low B.T.U. or low quality gas source into one of high quality by relatively inexpensive means, namely, by gas enriching means either in the form of a generated gas and/or carbon particles blown into the flame.

While we have illustrated and described several embodiments of our invention, it will be understood that these are by way of illustration only and that various changes and modifications may be contemplated in our invention and within the scope of the following claims.

We claim:

1. A gas enricher comprising a container having a removable lid, an inverted cone shaped foraminous base therein supporting a bed of petro-chemical solid elements, which material, when dissolved in gasoline, liberates a gas, said container having vertical sidewalls which are perforated at a level above said foraminous base and being surrounded by a tank partially filled with gasoline which completely immerses said bed and foraminous base, means providing a source of compressed gas leading to an inlet pipe in the interior of said container directly beneath said bed, and an outlet pipe at the top of said tank, whereby when said gas is passed through said bed, it will mix with the gas generated by said dissolving solid elements to provide enriched, combustible gas above the surface of said gasoline which flows through said perforated sidewalls and through said outlet pipe.

2. A gas enricher as recited in claim 1 wherein said inlet pipe includes perforated means for diverting gas from said inlet pipe to the surface of said foraminous base.

3. A gas enricher as recited in claim 1 wherein said bed of petro-chemical elements is naphthalene in pellet form.

4. A gas enricher as recited in claim 1 wherein said gas is air, together with means providing a high pressure for introducing said air into said container beneath said bed, and a gas burner supplied by said outlet pipe.

5. A gas enricher as recited in claim 4 wherein said means providing high pressure air is a pneumatic tire.

6. A gas enricher as recited in claim 4 wherein a second gas enricher is connected in series by connecting said outlet pipe to the inlet pipe at the bottom of said second gas enricher.

7. A gas enricher as recited in claim 1 together with a further enricher connected in parallel with said outlet pipe, said further enricher comprising means injecting a source of carbonaceous material in powdered form into the stream of enriched gas flowing from said outlet pipe, whereby when said enriched stream and carbonaceous material are ignited, they will be fueled by both said enriched gas and burning particles of said carbonaceous powder.

* * * * *